US010329778B2

(12) United States Patent
Koster

(10) Patent No.: US 10,329,778 B2
(45) Date of Patent: Jun. 25, 2019

(54) PRESSURE PLATE WITH INTEGRATED PRESSURE INDICATOR

(71) Applicant: Stouffville Glass Inc., Stouffville (CA)

(72) Inventor: Norman Koster, Stouffville (CA)

( * ) Notice: Subject to any disclaimer, the term of this patent is extended or adjusted under 35 U.S.C. 154(b) by 0 days.

(21) Appl. No.: 15/783,092

(22) Filed: Oct. 13, 2017

(65) Prior Publication Data

US 2018/0106052 A1 Apr. 19, 2018

(30) Foreign Application Priority Data

Oct. 14, 2016 (CA) ..... 2945338

(51) Int. Cl.

| | |
|---|---|
| ***E04B 2/96*** | (2006.01) |
| ***E06B 3/54*** | (2006.01) |
| ***E04F 21/28*** | (2006.01) |
| ***E04F 21/00*** | (2006.01) |
| *E04B 2/88* | (2006.01) |

(52) U.S. Cl.

CPC ..... *E04F 21/28* (2013.01); *E04F 21/0092* (2013.01); *E06B 3/54* (2013.01); *E06B 3/5481* (2013.01); *E04B 2/88* (2013.01)

(58) Field of Classification Search

None

See application file for complete search history.

(56) References Cited

U.S. PATENT DOCUMENTS

| | | | | | |
|---|---|---|---|---|---|
| 3,778,956 | A * | 12/1973 | Martin | A47F 3/12 | 411/389 |
| 4,552,790 | A * | 11/1985 | Francis | E04D 3/08 | 428/34 |
| 4,707,959 | A * | 11/1987 | Stoakes | E04B 2/965 | 52/235 |
| 4,887,402 | A * | 12/1989 | Da Col | E06B 3/5427 | 52/235 |
| 4,903,454 | A * | 2/1990 | Rose | E04B 2/96 | 52/235 |
| 5,592,795 | A * | 1/1997 | Rinehart | E04B 2/967 | 52/204.591 |
| 5,937,597 | A * | 8/1999 | Sono | E06B 1/36 | 49/DIG. 1 |
| 6,016,632 | A * | 1/2000 | McGee | E04B 2/7455 | 52/241 |
| 6,202,383 | B1 * | 3/2001 | Reiter | E04F 11/1851 | 52/474 |
| 6,735,912 | B2 * | 5/2004 | Riggio | E04D 3/08 | 52/235 |
| 6,761,003 | B2 * | 7/2004 | Lind | E06B 3/5436 | 403/293 |
| 7,975,442 | B1 * | 7/2011 | Frey | E04B 2/967 | 52/204.5 |
| 2002/0189178 | A1 * | 12/2002 | Lind | E06B 3/5436 | 52/235 |

(Continued)

*Primary Examiner* — Kyle J. Walraed-Sullivan

(74) *Attorney, Agent, or Firm* — Gilbert's LLP; Matthew D. Powell

(57) ABSTRACT

A pressure plate for securing at least one glass pane or panel against a frame includes a particular configuration of opposed wings adjoined by at least one resilient web, where raised portions of the opposed wings are moveable across a space towards each other thereby to bend the at least one resilient web out of a rest condition about a line of flexure an amount in proportion to the amount of force applied to the opposed wings.

4 Claims, 5 Drawing Sheets

(56) References Cited

U.S. PATENT DOCUMENTS

2003/0059252 A1* 3/2003 Gasparotto ..... E06B 3/5436 403/293
2004/0221526 A1* 11/2004 Rinehart ..... B32B 17/10036 52/204.62
2005/0284046 A1* 12/2005 Neal ..... E06B 1/36 52/204.5
2005/0284053 A1* 12/2005 Grunewald ..... E04B 2/96 52/235
2006/0201084 A1* 9/2006 Arias ..... E04B 2/965 52/235
2006/0213139 A1* 9/2006 Stramandinoli ..... E04B 2/885 52/384
2007/0125014 A1* 6/2007 Eckelt ..... B32B 17/10 52/204.5
2007/0199261 A1* 8/2007 Lang ..... E04B 2/967 52/204.5
2008/0053023 A1* 3/2008 Stenvall ..... E06B 3/5436 52/474
2008/0314089 A1* 12/2008 Ting ..... B65G 49/061 65/374.12
2010/0115863 A1* 5/2010 Braybrook ..... E04B 2/96 52/204.62
2010/0293882 A1* 11/2010 Labrecque ..... E04B 2/967 52/705
2011/0056162 A1* 3/2011 Bai ..... E06B 3/5427 52/698
2011/0113706 A1* 5/2011 Krause ..... F41H 5/263 52/204.5
2011/0296775 A1* 12/2011 Dolby ..... E06B 3/5427 52/204.6
2011/0298185 A1* 12/2011 Dolby ..... E06B 3/5427 277/630
2012/0031022 A1* 2/2012 Morgan ..... E06B 3/5436 52/204.62
2012/0066991 A1* 3/2012 Swartz ..... E06B 3/5427 52/235
2012/0167508 A1* 7/2012 Rasmussen ..... E04B 2/90 52/309.13
2012/0210658 A1* 8/2012 Logan ..... E04B 2/88 52/173.1
2014/0090324 A1* 4/2014 Houben ..... E04B 2/72 52/475.1
2015/0284951 A1* 10/2015 Frederick ..... E04B 2/965 52/235
2016/0017596 A1* 1/2016 Ballesteros ..... E04B 5/46 52/582.1
2016/0053487 A1* 2/2016 Frederick ..... E04B 2/90 52/235
2016/0069073 A1* 3/2016 Grise ..... E04B 2/967 52/235
2017/0022708 A1* 1/2017 Dolby ..... E04B 2/967
2017/0089120 A1* 3/2017 Moller ..... E06B 3/263
2017/0298621 A1* 10/2017 Frederick ..... E04B 2/967

* cited by examiner

PRESSURE PLATE WITH INTEGRATED PRESSURE INDICATOR

CROSS-REFERENCE TO RELATED APPLICATION

This application claims priority to Canadian Patent Application No. 2,945,338 filed on Oct. 14, 2016.

FIELD OF THE INVENTION

This invention relates to glass window panes or panels. In particular this application relates to a pressure plate or "dutchy" for temporarily holding a glass pane or panel in position after installation.

BACKGROUND OF THE INVENTION

Glass panes or panels form an important part of a building, contributing to aesthetics, weather-proofing and ambient light within the structure during the daytime.

In a conventional building structure, the building frame provides a mullion to which large glass panes or panels, often two or more panes overlaying one another and separated along their edges by spacers, are mounted using a sealant such as silicone to secure the panes in place. As is well known, the mullion has a raised channel extending generally centrally along the length of its front face, which channel may have ribbed internal side walls adapted to threadedly receive a screw. A window frame is formed by mullions that bound the four sides of the glass pane or panel known as a capped system, within the bounds of the raised channels. The windows are installed by applying a bead of silicone to the portions of the mullion faces 'inside' the channel, about the entirety of the mullion frame, and a glass pane or panel is mounted to the faces of the mullions to adhere to the silicone sealant. Sometimes a window frame may only have one, two or only three sides of exterior raised channels or pressure plates and the other sides simply installed with silicone sealant.

Once the glass panes or panels have been mounted to both sides of the mullion channel, a temporary holding block known as a pressure plate or "dutchy" is screwed to the mullion channel overlapping the side edges of the glass or panels which abut the front face of the mullion, typically using a self-tapping metal screw. The dutchies are maintained in position until the silicone has cured, at which point the dutchies are removed and a finishing trim or exterior silicone seal is applied to the front faces of the mullions, concealing the channel and the edges of the window pane.

Current techniques utilize a dutchy, typically formed from aluminium and often cut from excess pieces of trim that will be used to finish the mullions after the silicone has cured. There are a number of problems associated with this practice.

First, aluminium dutchies are created for use on the construction site. This requires time to cut the plate from a larger piece of trim and drill a hole in the right place, generally centrally along the length of the plate, and sometimes re-drill the hole if the initial hole is not positioned correctly. Then a tape or gasket is applied to the surface of the dutchy that will contact the glass or panel, to protect from direct contact to the finished surface. This involves some amount of labour, and once the dutchies are removed they become irrecoverable scrap and are discarded, so the time spent creating the dutchies is ultimately wasted, as are the materials.

Further, there is no gauge indicating how tightly to fasten the screw holding the dutchy in place. If the screw is over-tightened the glass pane can crack, requiring significant time and cost to replace.

In some cases the dutchy undergoes deformation due to over-tightening of the screw. This reduces the force applied by the dutchy to the glass pane, creating a risk of dislodgement of the glass pane or panel or its separation from the face of the mullion. In either case this diminishes the structural integrity of the window and potentially requires reinstallation or replacement of the glass pane or panel.

Applying the correct amount of torque to the screw to transfer sufficient force to the glass pane, so as to hold the glass pane in place during the curing cycle without cracking the glass, is often merely the result of fortuitous guesswork. Even where this is achieved, when an aluminium dutchy undergoes plastic deformation under a wind load after installation the dutchy will not return to its original profile and therefore loses some of its fastening strength, potentially leading to the problems identified above.

It would accordingly be beneficial to provide a dutchy which overcomes some or all of the aforesaid problems.

BRIEF DESCRIPTION OF THE DRAWINGS

In drawings which illustrate by way of example only a preferred embodiment of the invention.

DETAILED DESCRIPTION OF THE INVENTION

Figure 1:
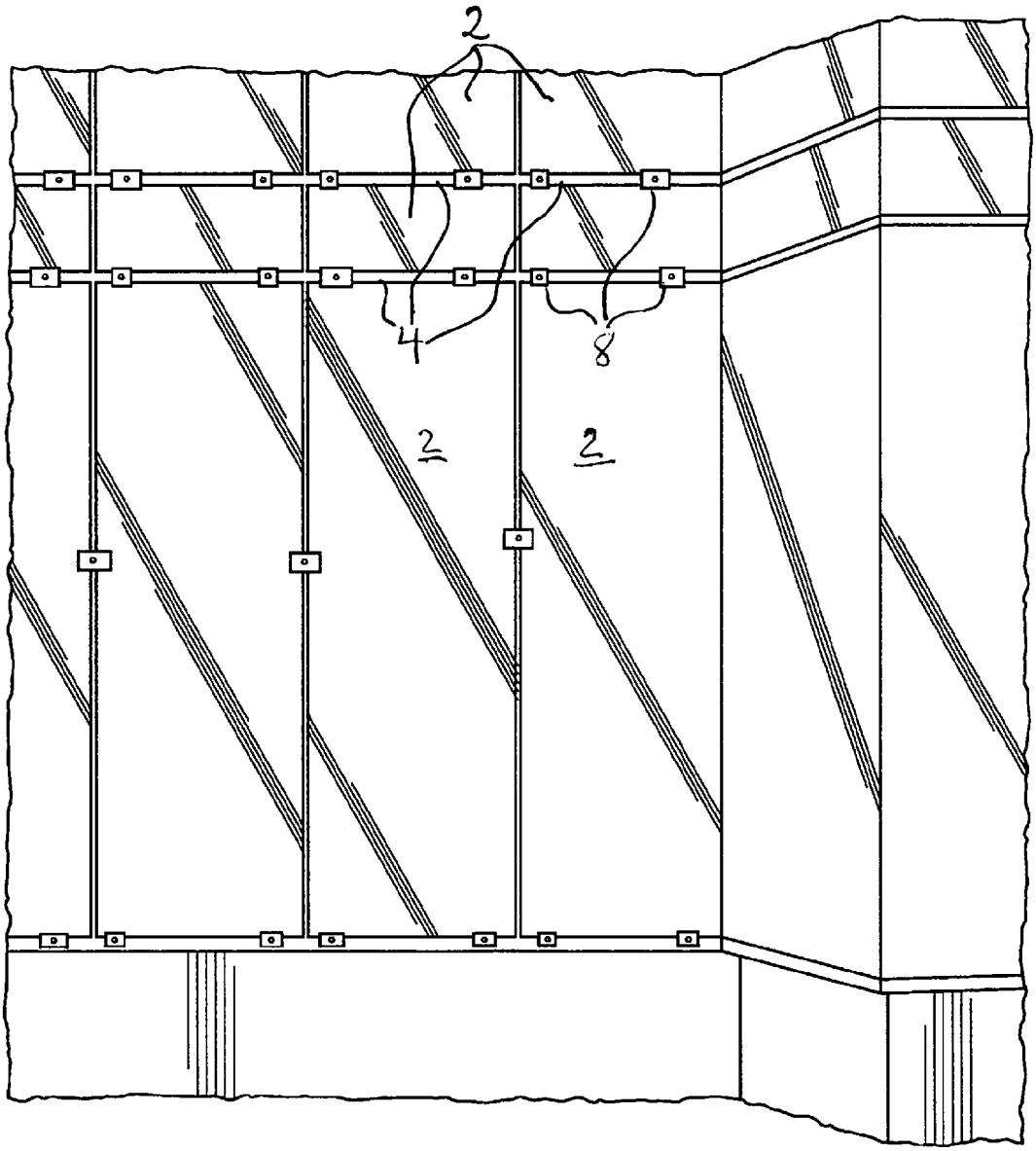
Fig. 1 (Prior art)
FIG. 1 is an elevation of a building façade showing prior art dutchies temporarily securing glass panes to window mullions.

FIG. 1 illustrates prior art aluminium dutchies 8 temporarily securing glass panes 2 to the window mullions 4 of a building façade in accordance with the current practice. Each dutchy 8 is cut from an aluminium extrusion, for example extra strips of the trim that will be used to finish the mullions, and screwed to the window mullions 4 through a hole drilled generally centrally along the length of the dutchy. A tape or gasket (not shown) is applied to the rear surface of the dutchy 8, i.e. the surface in contact with the glass panes 2, to protect the glass or panel.

A dutchy 10 according to the invention, for fastening to a frame to secure at least one glass pane or panel against the frame, is illustrated in FIGS. 2 to 6.

The dutchy 10 is formed from opposed wings 12, 14 adjoined by at least one flexible web 16. The dutchy 10 in the embodiment illustrated has two webs 16, one adjoining the wings 12, 14 at each end of the dutchy 10. In some embodiments the webs 16 are formed from plastic, for example polycarbonate which has the strength to flex without plastic deformation under the pressures required to effectively hold a glass pane or panel in position for the required amount of time, and the durability to withstand harsh weather conditions and a wide temperature range. In embodiments in which the wings are formed from plastic the entire dutchy may be formed from plastic, for example (without limitation) injection molded, due to the expedience and lower cost of forming the dutchy from a single material in a single step. However, it will be appreciated that since the only portion of the dutchy that needs to be flexible are the webs, rigid materials may be used for other components of the dutchy and the manufacturing techniques used may be adjusted accordingly.

The webs 16 are disposed substantially within a plane containing a line of flexure L (shown in FIG. 2) along which each web 16 bends when the dutchy is compressed during mounting. The webs 16 extend between the wings 12, 14 and are adjoined (preferably formed integrally during the molding process) with each wing 12, 14 to hold the wings 12, 14 in a spaced apart position as described below.

Figure 5:
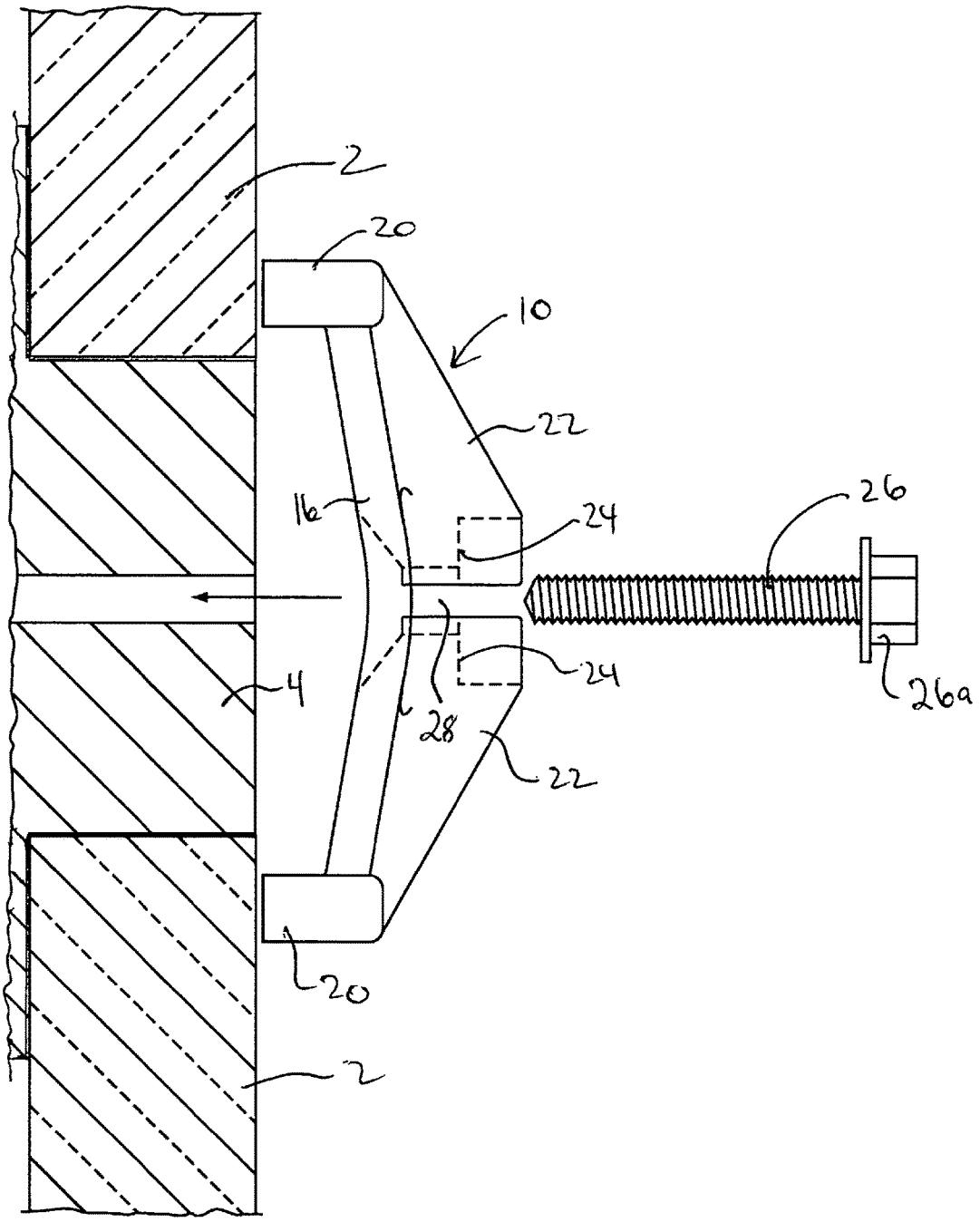
FIG. 5 is an end elevation of the dutchy of FIG. 2 in a relaxed condition prior to being installed to a mullion.

Each web 16 may be formed with a slightly curvate profile, so as to arch slightly forwardly as best seen in FIG. 5, which spaces an intermediate portion of the web 16 from the frame formed by the window mullions 4 (allowing room for the web 16 to flex toward the frame), and offers slightly greater compressive strength when the dutchy 10 is mounted. Each wing 12, 14 may optionally comprise one or more feet 20 for bearing against the glass pane or panel 2 when the dutchy 10 is mounted. In the embodiment shown the feet 20 project rearwardly beyond the rear faces of the webs 16, further spacing the webs 16 from the frame formed by the window mullions 4.

Figure 6:
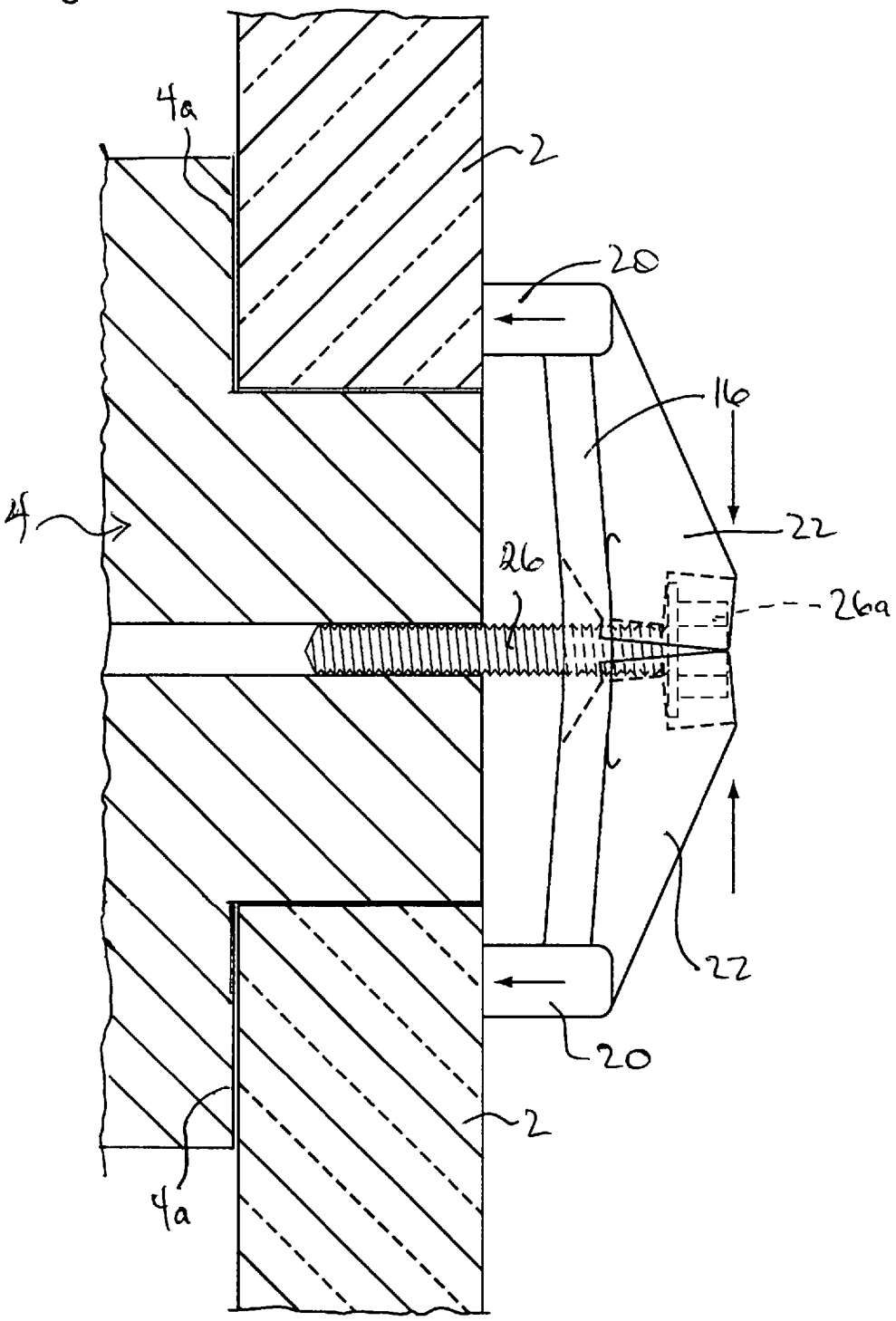
FIG. 6 is an end elevation of the dutchy of FIG. 2 in a compressed condition after being installed to a mullion.

Each wing 12, 14 further comprises at least one raised portion 22 projecting forwardly beyond the front faces of the webs 16. The raised portions 22, best seen in FIGS. 5 and 6, are disposed on either side of the line of flexure L and spaced apart by a predetermined distance when the dutchy 10 is in the rest or unloaded condition, as at 28 in FIG. 5.

Figure 2:
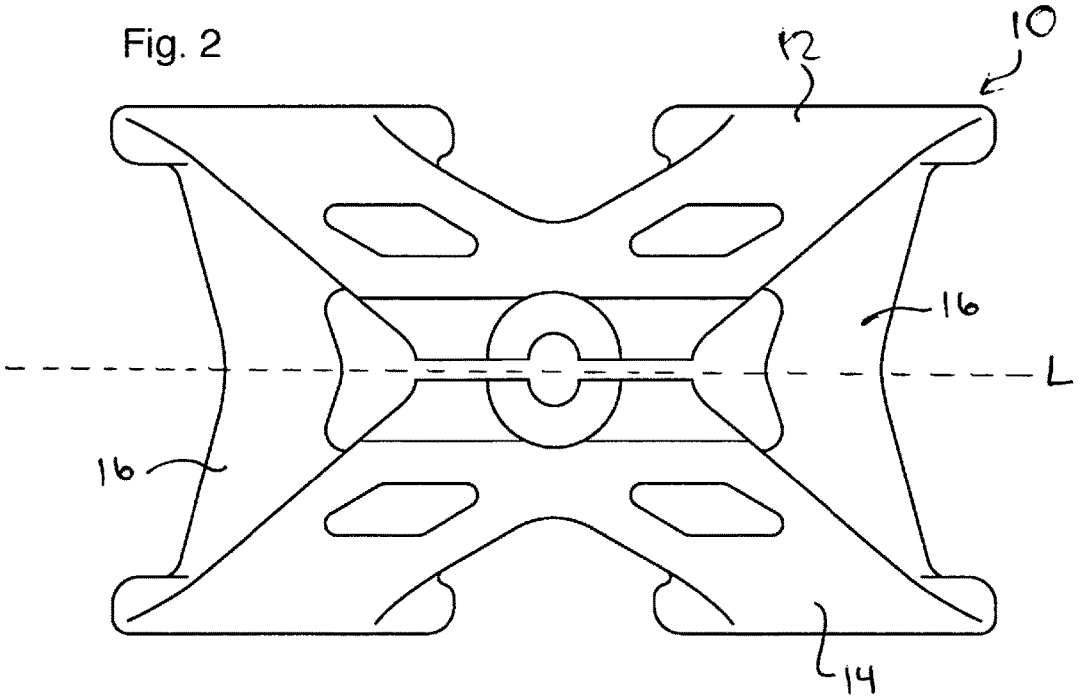
FIG. 2 is a plan view of a dutchy according to the invention.
Figure 3:
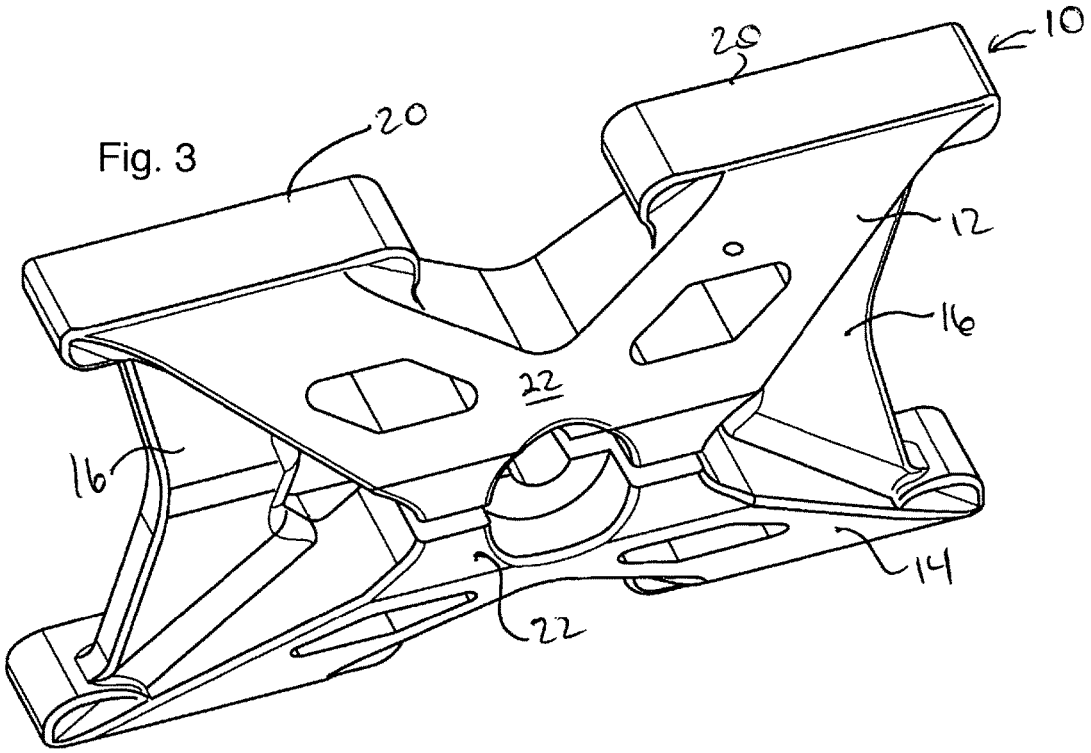
FIG. 3 is a front perspective view of the dutchy of FIG. 2.
Figure 4:
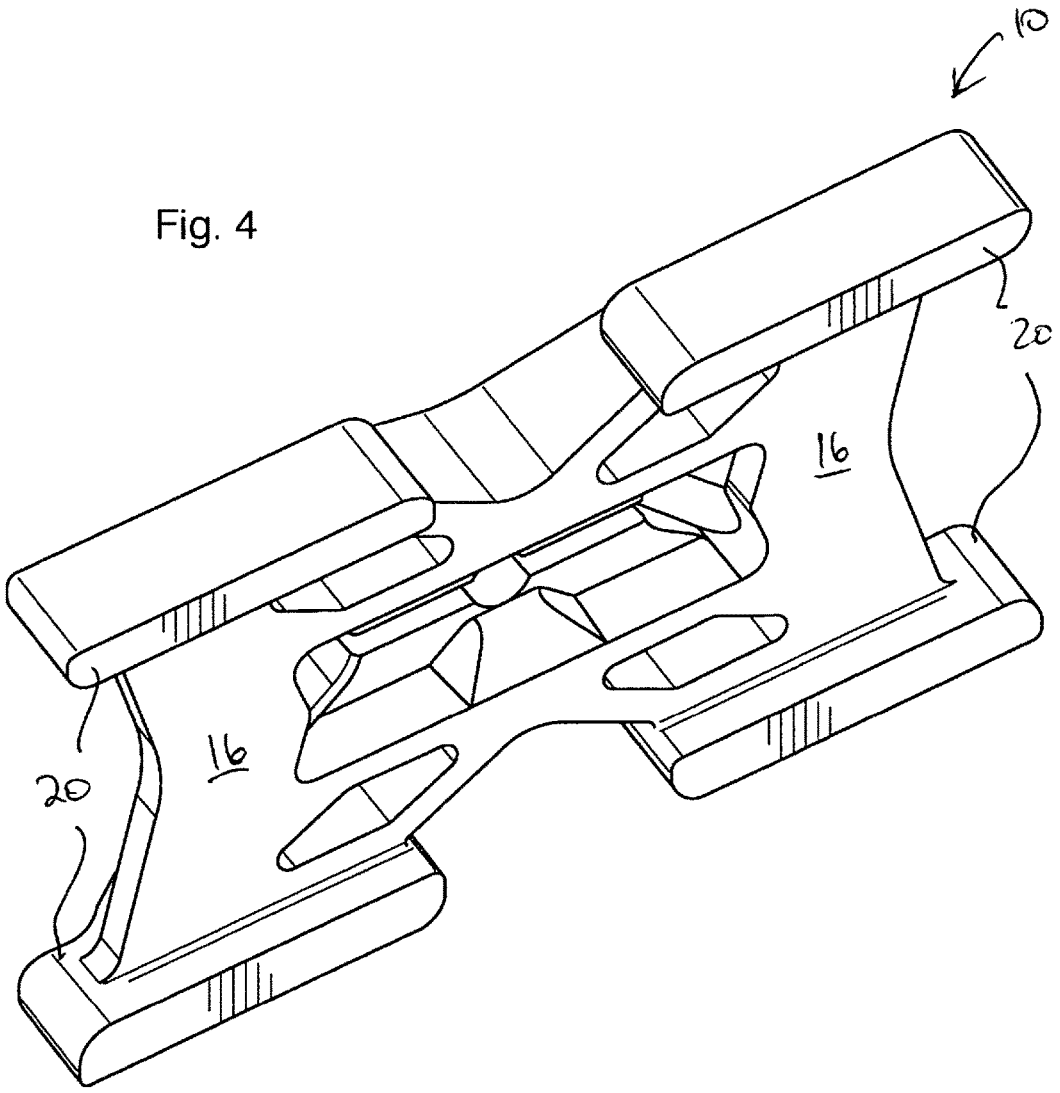
FIG. 4 is a rear perspective view of the dutchy of FIG. 2.

The opposed raised portions 22 of the wings 12, 14 are thus spaced apart along the line of flexure L. The raised portions 22 each provide a bearing surface 24 for engagement by at least one fastener 26, disposed at a position between the respective feet 20 of the opposed wings 12, 14, preferably generally centrally as shown. In the embodiment shown the bearing surfaces 24 bound the space 28 generally centrally along the length of the dutchy 10, as can be seen in FIG. 2.

When a force is applied to the bearing surfaces 24, the webs 16 flex toward the frame formed by the mullions 4. Thus, in use, when the self-tapping metal screw 26 is disposed through the space 28 at the compression point represented by the bearing surfaces 24, as the screw 26 is set into the mullion 4 the head 26*a* of the screw contacts the bearing surfaces 24. Further rotation of the screw 26 to drive it into the mullion 4 causes the opposed raised portions 22 to move toward each other in proportion to the amount of the applied force. In the preferred embodiment the space 28 is designed to be a distance whereby when the raised portions 22 of the wings 12, 14 touch, the correct amount of compressive force is being applied to the dutchy 10 so as to securely hold the glass pane(s) 2 against the seat 4*a* of the window frame formed by the window mullions 4, as shown in FIG. 6.

To remove the dutchy 10, the screw 26 is rotated in the reverse direction to detach the dutchy 10 from the mullion 4.

Utilizing the dutchy 10 of the invention, if a glass pane or panel 2 under the influence of a wind load causes the dutchy 10 to deform, the deformation is elastic so the dutchy 10 will recover as soon as the wind load dissipates, and none of the fastening strength of the dutchy 10 is lost.

A bight or annulus (not shown) may be provided through any convenient portion of the dutchy 10, or affixed to the dutchy 10 (for example by a web formed when molding the dutchy 10), to hold the screw 26. This facilities installation and removal by ensuring the screw is immediately available when the dutchy 10 is installed, and by providing a place to stow the screw when the dutchy 10 is demounted.

It is also possible to embed electrodes (not shown) at a selected point along the upper ridges of each raised portion 22 along the space 28, serving as a switch in a circuit with a small battery (or other power source such as a photovoltaic cell) and an LED which will illuminate when the electrodes touch to indicate when the correct amount of force has been applied to the dutchy and installation is complete.

Various embodiments of the present invention having been thus described in detail by way of example, it will be apparent to those skilled in the art that variations and modifications may be made without departing from the invention. The invention includes all such variations and modifications as fall within the scope of the appended claims.

The invention claimed is:

1. A pressure plate to secure at least one glass pane or panel against a frame, comprising:

opposed wings adjoined by at least one resilient web, each of the at least one resilient web extending between respective ends of the opposed wings and being resiliently bendable about a line of flexure, each of the at least one resilient web in a rest condition maintaining a space along the line of flexure between respective raised portions of the opposed wings that project forwardly beyond a front face of the at least one resilient web, each of the raised portions incorporating a respective bearing surface adjacent to the space and dimensioned to engage a respective portion of a head of a fastener passed through the space towards a frame; and at least one foot associated with each respective end of the opposed wings and extending beyond a rear face of the at least one resilient web, wherein the raised portions of the opposed wings are moveable across the space towards each other thereby to bend the at least one resilient web out of the rest condition about the line of flexure.

2. The pressure plate of claim 1, wherein an intermediate portion of each of the at least one resilient web is arched in the rest condition.

3. The pressure plate of claim 1, wherein the distance of the space is selected according to a desired compressive force of the at least one resilient web when the raised portions are in contact.

4. The pressure plate of claim 1, wherein the opposed wings and the at least one resilient web are formed from plastic.

* * * * *